US005523928A

United States Patent [19]

Kim

[11] Patent Number: 5,523,928

[45] Date of Patent: Jun. 4, 1996

[54] PEN WITH ILLUMINATOR

[76] Inventor: Dong Hwan Kim, 70-93 (7/3) Naesu-dong, Chongro-Ku, Seoul 110-070, Rep. of Korea

[21] Appl. No.: 438,658

[22] Filed: May 9, 1995

[30] Foreign Application Priority Data

Aug. 2, 1994 [KR] Rep. of Korea ..... 94-12726

[51] Int. Cl.[6] ..... B43K 29/10

[52] U.S. Cl. ..... 362/118; 362/343; 362/800; 401/195

[58] Field of Search ..... 362/32, 118, 186, 362/800, 255, 343; 401/195

[56] References Cited

U.S. PATENT DOCUMENTS

| | | | |
|---|---|---|---|
| 2,979,602 | 4/1961 | Barnett | 362/118 X |
| 4,518,274 | 5/1985 | Hanggi | 362/118 X |
| 4,737,894 | 4/1988 | Kuch et al. | 362/118 |
| 4,890,204 | 12/1989 | Lin et al. | 362/118 |
| 5,131,775 | 7/1992 | Chen | 362/118 X |
| 5,405,208 | 4/1995 | Hsieh | 362/118 X |

*Primary Examiner*—Stephen F. Husar
*Attorney, Agent, or Firm*—Banner & Allegretti, Ltd.

[57] ABSTRACT

This invention relates to a pen with illuminator allowing users to write even in the dark by illuminating the surface to be written on. A pen with illuminator comprises a writing element; a barrel for accommodating the writing element; a light emitting diode unit having a carrier made of light transmittible material and a light emitting diode chip embedded in the carrier. The light emitting diode unit is mounted in the front end opening to expose at least a part of the carrier to the exterior and having a central penetrating hole for allowing the nib of the writing element to pass therethrough. There is provided with means for reflecting light emitted from the light emitting diode chip toward a predetermined direction.

4 Claims, 3 Drawing Sheets

PEN WITH ILLUMINATOR

BACKGROUND OF THE INVENTION

This invention relates to a pen with illuminator allowing users to write even in the dark by illuminating the surface to be written on.

This illuminable pen provided with the illumination means is known from, for example, U.S. Pat. Nos. 4,737,894, and 4,890,204. These known pens, however, employ a lamp of resistance type which has, however, problems relating to heat-emitting, relatively large required space, weight, electric consumption, etc.

As a proposition to eliminate these disadvantages, a pen with an illuminator is disclosed by U.S. Pat. No. 5,131,775, in which an LED(light emitting diode) is employed as the illuminator. The LED includes a pair of chips embedded at both sides of a writing element to illuminate uniformly the writing surface. However, embedding of two chips in one LED causes several problems in productability, workability, increase of cost, ete. It needs, moreover, registor to cause the cost to increase correspondingly.

Accordingly, it is an object of the invention to provide a pen with illuminator having a single LED chip, which can nevertheless illuminate relatively uniformly the writing surface and can be manufactured relatively readily and inexpensively.

The object discussed above is solved according to the invention by a pen with illuminator comprising a writing element having a reservoir tube and a nib; a barrel for accommodating the writing element and having a front end opening; a light emitting diode unit having a carrier made of light transmittible material and a light emitting diode chip embedded in the carrier, the light emitting diode unit being mounted in the front end opening to expose at least a part of the carrier to the exterior and having a central penetrating hole for allowing the nib of the writing element to pass therethrough; a dry battery for providing the light emitting diode chip with electrical energy; a switching means for switching the electrical connection between the light emitting diode chip and the dry battery; and means for reflecting light emitted from the light emitting diode chip toward a predetermined direction. Since the light emitting of the LED chip can be transmitted to the opposite direction of the chip in the carrier by the reflecting means, it is possible to obtain relatively uniform illumination by using a single chip.

The reflecting means may be formed as a reflecting layer surrounding cylindrically the carrier of the light emitting diode unit, and the reflecting layer can be obtained by coating the inner wall surface of said front end opening with reflecting material. Otherwise, the reflecting means may be embeded in the carrier in a form of a reflecting plate. In the case, the reflecting plate can also serve as a connecting terminal for the light emitting diode chip.

It is, preferabe that the carrier of the LED unit contains light dispersing material to increase the dispersing of the light in the carrier to aid uniform illumination therein.

DETAILED DESCRIPTION OF THE INVENTION

Figure 1:
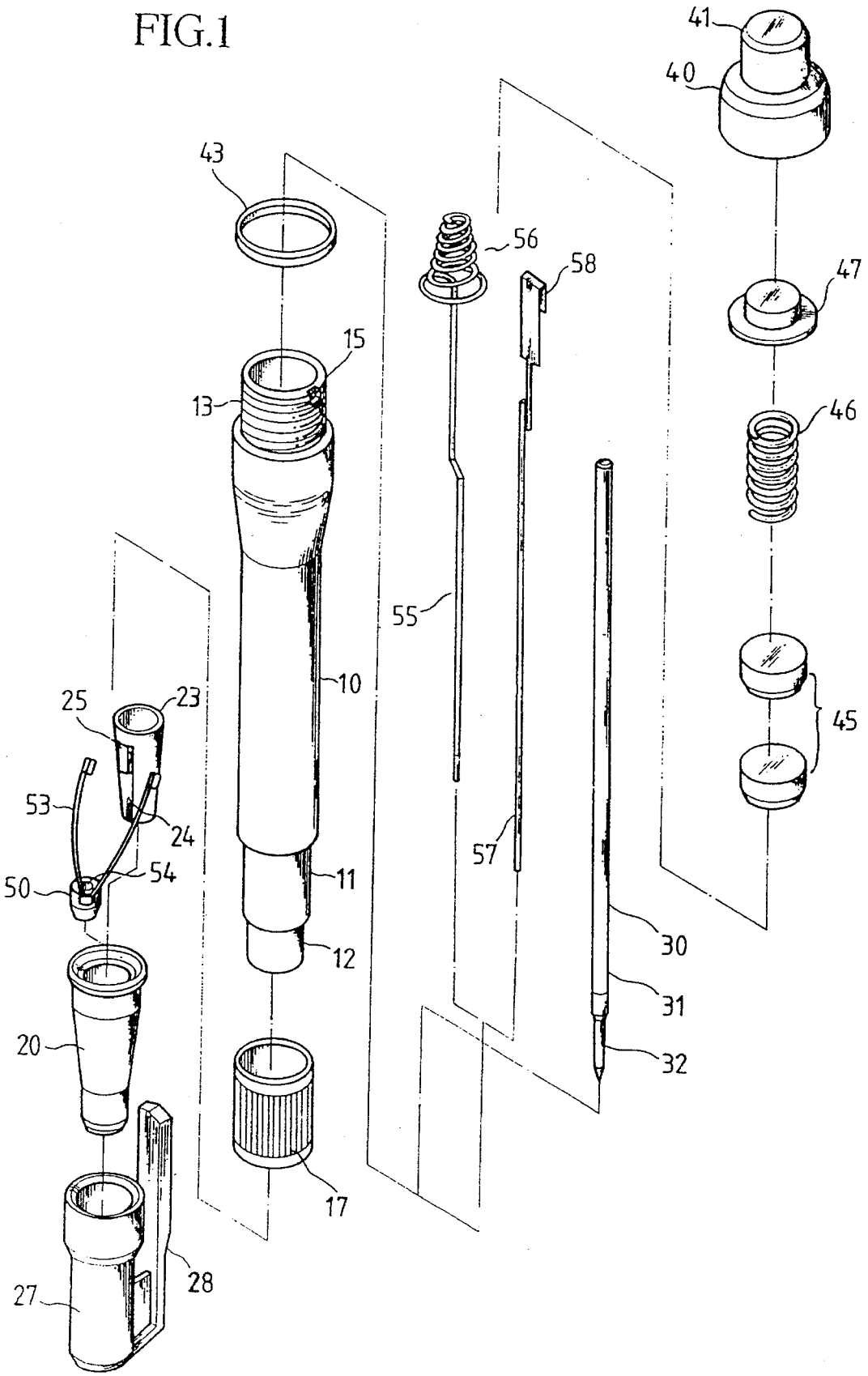
FIG. 1 is an exploded perspective view of a pen with illuminator in accordance with the present invention.
Figure 2:
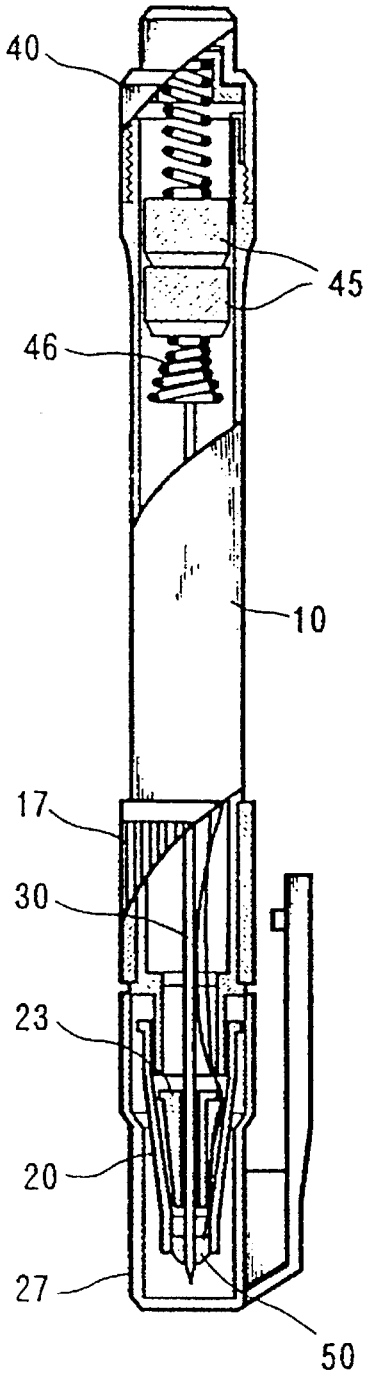
FIG. 2 is a fragmentary sectional view of the assembed pen.
Figure 3:
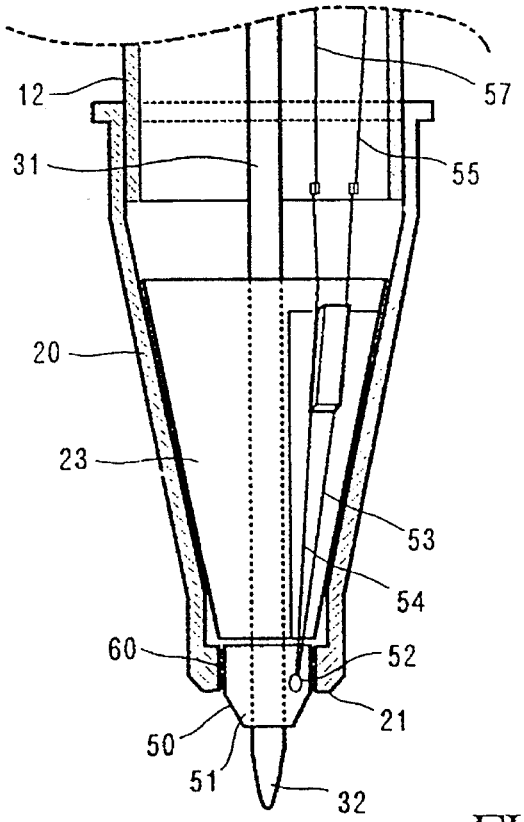
FIG. 3 is an enlarged sectional view of the front end portion of the pen.

FIG. 1 is an exploded perspective view of a pen with illuminator in accordance with the present invention, FIG. 2 is a fragmentary sectional view of the assembed pen, and FIG. 3 is an enlarged sectional view of the front end portion of the pen.

As shown in FIG. 1 to FIG. 3, the pen with illuminator has generally, like ordinary pens, a tubular barrel 10, a tapered front end member 20 fixed to the front end of the barrel 10, a writing element 30 accommodated in the barrel 10 and having a nib 32 protruding through the front end opening defined at the front end member 20, a cover 40 closing openably the rear end of the barrel 10, and a cap 27 separably covering the front end member 20 for protecting the nib 32 of the writing element 30 and having a clip 28. There is also provided with an annular grip element 17 made of rubber surrounding a part of the barrel 10 next to the front end element 20 to improve gripping by fingers.

LED unit 50 for illumination is comprised of a carrier 51 made of a light transmittible material and an LED chip 52 embedded in the carrier 51. The LED chip 52 is connected with a pair of lead pin 53 for transmitting electric energy thereto. The unit 50 has a penetrating hole formed along the central axis to be passed by the nip 32 of the writing element 10 through, thereby LED unit 50 has substantially cylindrical shape with the front end region having a top-cutted conical shape.

Preferably, the carrier 51 contains light dispersing material for propagating the light generated by LED chip 52 broadly in the carrier 51 as uniformly as possible.

A cylindrical portion of the LED unit 50 is mounted in the front end opening 21 of the front end member 20, and the conical portion thereof is exposed to the outer side. As shown in FIG. 3, a reflecting layer 60 is interposed between the cylindrical portion of the LED unit 50 and the inner wall surface of the front end opening 21. The reflecting layer 60 may be formed by coating of a suitable material, otherwise, and can be obtained by attaching a separate reflectable strip.

Conducting wires 55, 57 which extend toward the top of the barrel 10 are connected to the end of each of lead pins 53 from the LED chip 52 respectively. On the upper end of the conducting wire 55 lies a contact spring 56, on which a pair of dry battery are placed in series and accomodated in the upper end region of the barrel 10. On the dry battery 45, a spring 46 and a movable contact 47 made of a conductive material are placed in turn, and are pressed down by the cover 40. On the other hand, the upper end of the other conducting wire 57 has a latch-like contact strip 58, which is hung on a peripheral edge of the upper end opening of the barrel 10. The bended portion of the contact strip 58 is placed in a cut-out 15 formed in the upper end of the barrel 10 to prevent the contact strip 58 from interfering opening and closing movement of the cover 40.

The cover 40 has an inner thread corresponding to an outer thread 13 formed in the upper end region of the barrel 10 to engage with the barrel 10 with interposition of a ring 43. When the cover 40 is screwed down on the barrel 10 against the elastic force of the conducting spring 46 to contact the movable contact 47 with the contact strip 58 which is hung on the upper peripheral edge of the barrel 10. In this condition, if a user screws back the cover 40 to loosen, the movable contact 47 becomes apart from the contact strip 58 and the electric contact therebetween becomes blocked. In this manner, the turning on/off of the LED chip 52 is switched.

A guide element 23 is, when assembled, inserted in the front end member 20 to prevent the lead pin 53 of the LED chip 52 from contacting each other or being interfered by the writing element 30. The guide element 23 is formed as the tapered cylindrical body with the penetrating hole through which the writing element 30 can pass, and has a cut-out 24 formed on the outer surface thereof and a prominence 25 formed on the cut-out 24. The two lead pins 53 of the LED chip 52 pass by the prominence 25, separated from each other at the both sides of the prominence 25. Since the two lead pins 53 are placed at each side of the prominence 25 respectively, the pins 53 are not interfered by the inner wall surface of the front end element 20 and the writing element 30, furthermore by each other.

In ordinary state without necessity of illuminating, one conducting wire 55 is always connected to one electrode of the battery 45 through the contact spring 56, while the contact strip 58 of the other conducting wire 57 is electrically separated from the movable contact 47 which is electrically connected to the other electrode of the dry battery through the conductive spring 46.

When a user wants to write in the dark, he can screw down the cover 40 against the barrel 10 to electrically contact the contact strip 58 and the movable contact 47 with each other. Accordingly, the LED chip 52 come to be supplied with electrical energy from the dry battery 4 to emit light.

A part of the light emitted by the LED chip 52 passes through the exposed surface of the carrier S1 to illuminate directly the front side of the front end, simultaneously another part of the light is reflected at the inner wall surface of the front end opening 21 by a reflecting layer 60 to be transmitted in the opposite side of the writing element 30, thereby the portion hidden by the nib 32 of the writing element 30 is indirectly illuminated.

To effectively diffuse the light from the LED 52 chip in the carrier 51, according to a preferable embodiment of the invention, a light dispersing material can be dispersed in the carrier 51. The light dispersing material diffuses the light from the LED chip 52 all over the carrier 51 and then the carrier 51 by itself can serve as a light emitter, so that a shadow made by the writing element 3 can not appear.

Turning off of the LED chip 52 can be easily made by screwing back the cover 40 by means of a knob 41 of the cover 40.

Figure 4:
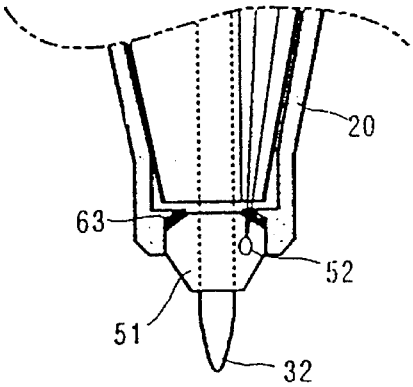
FIG. 4 is an enlarged sectional view of a front end portion of a pen according to another embodiment.

FIG. 4 is an enlarged sectional view of a front end portion of a pen according to another embodiment. In this embodment, the upper part of the LED unit 50 has a conical shape, and the reflecting layer 63 is formed along the conical surface. Thereby, the light from the LED chip 52 emits and is reflected more effectively toward the whole direction in the carrier 51 to illuminate the surface to be written on.

Figure 5A:
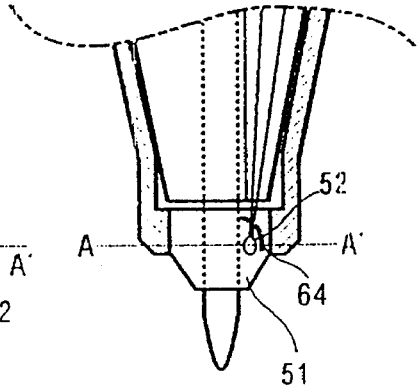
FIG. 5A and FIG. 5B are an enlarged longitudinal sectional view and a cross sectional view of a front end portion of a pen according to a further embodiment.
Figure 5B:
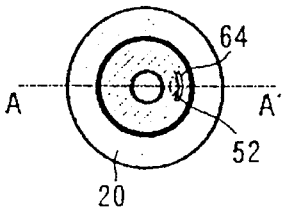

FIG. 5A and FIG. 5B are an enlarged longitudinal sectional view and a cross sectional view of a further embodiment according to the invention respectively. In this embodiment, a concave mirror type reflecting plate 64 is embeded in the carrier 51 of the LED unit 50. The reflecting plate 64 reflects the light from LED chip 52 toward the front side and the opposite side of the writing element 30, to illuminate effectively even the place shaded by the writing element 30.

Figure 6:
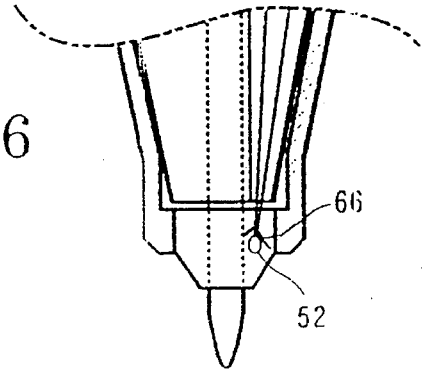
FIG. 6 is an enlarged sectional view of a front end portion of a pen according to a still further embodiment.

FIG. 6 is an enlarged sectional view of a still further embodiment according to the invention. In the embodiment, a shade-shaped reflector 66 is employed to reflect the light of the LED chip 52 toward the desired direction. Here, the reflector 66 serves also as the connecting terminal for the chip 52.

As described above, in accordance with the invention, the pen with illuminator having a single LED chip, which illuminates relatively uniformly and also can be manufactured simply and inexpensively, is provided.

What is claimed is:

1. Pen with illuminator, comprising a writing element having a reservoir tube and a nib;

a barrel for accommodating said writing element and having a front end opening;

a light emitting diode unit having a carrier made of light transmittable material and a light emitting diode chip embedded in said carrier, said light emitting diode unit being mounted in said front end opening to expose at least a part of said carrier to the exterior and having a central penetrating hole for allowing said nib of said writing element to pass therethrough;

a dry battery for providing said light emitting diode chip with electrical energy;

a switching means for switching the electrical connection between said light emitting diode chip and said dry battery; end means for reflecting light from said light emitting diode chip toward a predetermined direction, wherein said reflecting means comprises a reflecting plate embedded in said carrier of said light emitting diode unit.

2. Pen with illuminator according to claim 1, wherein said reflecting plate serves as a connecting terminal for said light emitting diode chip.

3. Pen with illuminator according to claim 1, wherein said carrier of said light emitting diode unit contains light dispersing material.

4. Pen with illuminator according to claim 2, wherein said carrier of said light emitting diode unit contains light dispersing material.

* * * * *